US005252418A

United States Patent [19]

Ishikawa et al.

[11] Patent Number: 5,252,418

[45] Date of Patent: Oct. 12, 1993

[54] ELECTROPHOTOGRAPHIC PHOTORECEPTOR WITH PROTRUDING INORGANIC INSULATOR PIECES AND AN ELECTROPHOTOGRAPHIC APPARATUS UTILIZING THE SAME

[75] Inventors: Fuminori Ishikawa, Hitachiota; Akira Sato, Takahagi; Kunihiro Tamahashi, Mito; Masatoshi Wakagi; Katsumi Tamura, both of Hitachi; Masanobu Hanazono, Mito; Mitsuyoshi Shoji, Ibaraki; Takayuki Nakakawaji, Hitachi; Yutaka Ito, Takahagi; Shigeki Komatsuzaki, Mito; Motoo Akagi, Tokyo; Masaaki Imamura, Odawara, all of Japan

[73] Assignee: Hitachi, Ltd., Tokyo, Japan

[21] Appl. No.: 567,180

[22] Filed: Aug. 14, 1990

[30] Foreign Application Priority Data

Aug. 25, 1989 [JP] Japan ..... 1-217362
Mar. 19, 1990 [JP] Japan ..... 2-67108

[51] Int. Cl.[5] ..... G03G 5/14

[52] U.S. Cl. ..... 430/67; 355/210; 355/211; 430/132

[58] Field of Search ..... 355/210, 211; 430/66–68, 67, 132

[56] References Cited

U.S. PATENT DOCUMENTS 4,740,439 4/1988 Tachikawa et al. ..... 430/67
4,789,612 12/1988 Haneda et al. .
4,804,607 2/1989 Atsumi ..... 430/130
4,939,056 7/1990 Hotomi et al. ..... 430/66
4,962,008 10/1990 Kimura et al. ..... 430/67
4,967,231 10/1990 Hosoya et al. ..... 355/219
5,008,172 4/1991 Rokutanzono et al. ..... 430/67
5,124,219 6/1992 Shintani ..... 430/67

*Primary Examiner*—John Goodrow
*Attorney, Agent, or Firm*—Antonelli, Terry, Stout & Kraus

[57] ABSTRACT

An electrophotographic photoreceptor comprising a photoconductive layer comprising a photoconductor, a support for the photoconductive layer and a surface layer formed on the photoconductive layer and comprising a curable resin film and an inorganic insulator pieces having a size larger than the film thickness of the curable resin film. In order to prevent the image blurring of an a-Si:H photoreceptor, on the outermost surface of the photoreceptor was formed a surface layer having a structure in which inorganic insulator pieces have protruded from the curable resin film. Since the curable resin is of high resistance and shows no quality change by corona irradiation, and besides the protruding inorganic insulator pieces prevent the abrasion of the resin, the surface layer having a long life and excellent humidity resistance, durability for corona irradiation and abrasion resistance can be realized. Further, by covering the surface layer with a fluorine-containing lubricant, the surface layer having a low friction coefficient and excellent cleaning characteristics is obtained, and besides the resin constituting the surface layer absorbs little moisture. As a result, it becomes possible to use the a-Si:H photoreceptors without a heater. Also, the surface layer of the present invention can be removed and then re-formed.

25 Claims, 6 Drawing Sheets

ELECTROPHOTOGRAPHIC PHOTORECEPTOR WITH PROTRUDING INORGANIC INSULATOR PIECES AND AN ELECTROPHOTOGRAPHIC APPARATUS UTILIZING THE SAME

BACKGROUND OF THE INVENTION

1. Field of the Invention

The present invention relates to an electrophotographic photoreceptor, a method for producing the same and electrophotographic apparatus, and more particularly to an electrophotographic photoreceptor suitable for producing good images even in printing under high humidity, a method for producing the same and electrophotographic apparatus.

2. Description of the Prior Art

As electrophotographic photoreceptors, there are conventionally used inorganic photoconductors such as Se, CdS, $As_2Se_3$, etc. and organic photoconductors represented by phthalocyanine pigments. These materials are superior in electrophotographic characteristics such as photosensitivity, charge acceptance, etc., but as to mechanical characteristics, have defects that the film hardness is low and the abrasion resistance is poor.

Contrary to this, amorphous silicon photoreceptors have a high hardness and excellent abrasion resistance, so that they are expected as long-life electrophotographic photoreceptors.

The amorphous silicon photoreceptors, however, have a defect of the humidity resistance being poor. Because of this, providing the photoreceptors with a surface protective layer made of a-SiC:H, a-SiN:H, etc. is commonly carried out, but it may not be said to be satisfactory.

Also, the printing process of electrophotography includes a charging process by corona discharge, so that repeating the printing process causes oxidation of the surface protective layer and lowering of the humidity resistance to result in a defect of image blurring occurring.

In order to overcome such a defect of photoreceptors, there are many proposals on various surface protective layers.

For example, Japanese Patent Application Kokai No. 55-84941 and No. 55-70848 disclose to provide the photoreceptors with a surface layer made of thermosetting resins or thermoplastic resins.

Also, Japanese Patent Application Kokai No. 56-51754 and Japanese Patent Application Kokai No. 58-23031 and No. 58-102949 disclose to provide the photoreceptors with a surface layer in which solid particles of polytetrafluoroethylene, etc. have been dispersed as a lubricant in thermoplastic resins or insulating resins.

Further, Japanese Patent Application Kokai No. 57-165848 discloses a surface layer in which an inorganic insulator has been dispersed in insulating resins. And, Japanese Patent Application Kokai No. 56-99347 and No. 57-165848 disclose a surface layer in which a lubricant and an abrasive such as alumina have been dispersed in resins.

Further, U.S. Pat. No. 3,954,466 is mentioned as a description of the prior art.

However, the surface protective layers of these conventional techniques have a problem of failing to fully satisfy all of the various characteristics required for the surface protective layer such as for example durability for corona irradiation, polishing abrasion resistance to paper, cleaning brushes, etc., cleaning characteristics at the time of removal of toners, prevention of a toner adhesion problem, etc. "Toner adhesion problem" referred to herein means a problem that a thermoplastic resin, etc. contained in broken pieces of a toner adheres to a photoreceptor in an aggregated or molten state never to be removed therefrom.

For example, the surface layer composed of a resin alone is in sufficient in the abrasion resistance when its film thickness is so small as not to affect the characteristics of photoreceptors.

When the surface layer is formed by dispersing particles of a solid lubricant such as polytetrafluoroethylene, etc. in a resin, an improvement in lubricity can be expected. However, the film strength lowers at the same time, so that the result is that there remains a problem of the abrasion resistance and durability being injured.

When particles of alumina, etc. are added in order to prevent a lowering in film strength, the lowering in lubricity is brought about unless particle size and particle concentration are made optimum, which results in problems such as lowering in the cleaning characteristics, toner adhesion problem, etc. The result is therefore that there remains a problem of failing to obtain characteristics expected of the surface protective layer.

SUMMARY OF THE INVENTION

An object of the present invention is to provide a surface layer satisfying various characteristics such as humidity resistance, durability for corona irradiation, abrasion resistance, cleaning characteristics, etc. in good balance, as well as a long-lived and high-reliability electrophotographic photoreceptor and a method for producing the same.

Another object of the present invention is to provide a high-reliability electrophotographic apparatus, particularly an electrophotographic apparatus loaded with an amorphous silicon photoreceptor requiring substantially no heating nor drying mechanism.

A further object of the present invention is to provide a method for using an electrophotographic photoreceptor at a low cost by replacing the surface layer alone of the above photoreceptor loaded on electrophotographic apparatus.

DESCRIPTION OF PREFERRED EMBODIMENTS

Figure 1:
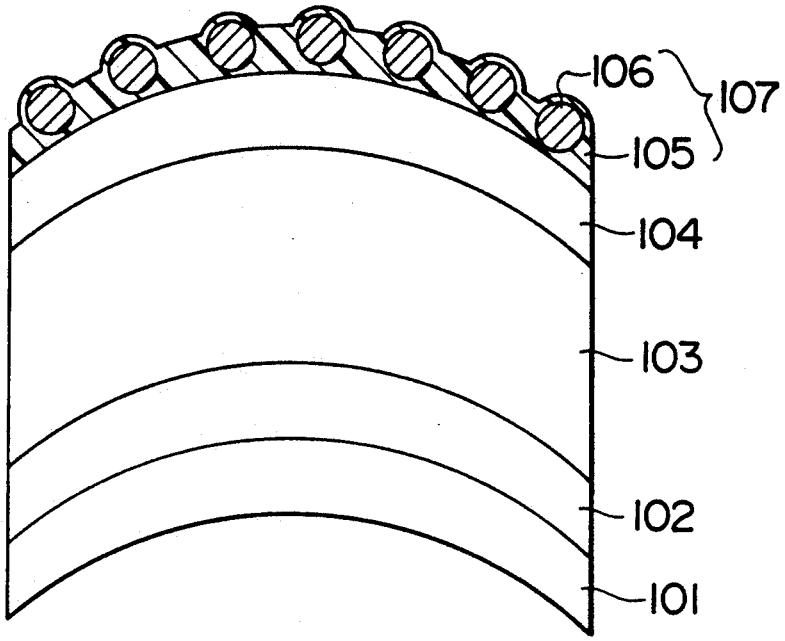
FIG. 1 is a sectional view of an amorphous silicon photoreceptor which is one embodiment of the present invention.

The electrophotographic photoreceptor of the present invention is characterized by comprising a photoconductive layer comprising a photoconductor, a support for the photoconductive layer and a surface layer formed on the photoconductive layer and comprising a curable resin film and inorganic insulator pieces, the inorganic insulator pieces protruding from the curable resin film.

Materials for the photoconductor may be any of the known ones such as amorphous silicon, amorphous carbon, amorphous silicon carbide, amorphous silicon nitride, metal or metal-free phthalocyanine, selenium, etc. Particularly, amorphous silicon itself and at least one of amorphous carbon, amorphous silicon carbide and amorphous silicon nitride are preferred.

As the inorganic insulator, silica, $\alpha$-alumina, $\gamma$-alumina, quartz, kaolin, mica, talc, hydrated alumina, potassium titanate, titanium dioxide, asbestos, clay, wollastonite, zinc oxide, silicon carbide, diamond, boron, boron nitride, etc. are preferred. Particularly, $\alpha$-alumina, diamond and boron nitride are preferred.

The inorganic insulator pieces are in the form of particles or fibers.

As the curable resin, those which are crosslinked in part or completely by curing are preferred. Any of thermosetting, photocurable and electron beam curable resins may be used. Preferred thermosetting resins are those which are cured by crosslinking at 400° C. or less, preferably 350° C. or less as well as have a low water absorption in terms of humidity resistance and a surface resistance of at least $10^{12}$ Ωcm or more.

In the electrophotographic photoreceptor of the present invention, "curable resin fllm" means a cured film obtained by curing a film composed of the curable resin. Therefore, in the curable resin film, the resin has been already crosslinked in part or completely.

Specific examples of the curable resin are epoxy resins, phenol resins, styrene resins, polyester resins, polyurethane resins, polyimide resins, polyamide resins and polyimideamide resins. Among these, epoxy resins are preferred in terms of adhesiveness to a substrate and polyimide resins are preferred in terms of abrasion durability.

The above curable resins in which, however, a part of their molecular structure has been fluorinated can be used. In this case, those having a proper fluorine content need to be selected so as not to lower the film hardness. Specifically, those which are described in Ind. Eng. Chem. Prod. Dev. Vol. 17, No. 1, 1978, pp. 10 to 14 are preferred.

For example, when epoxy resins are used as the curable resin, bisphenol A type, novolak type and tetrafunctional type epoxy resins may properly be selected, and it is most preferred to use a fluorine-containing epoxy resin having a low water absorption.

To crosslink the epoxy resin, it is desirable to properly select and use a resin such as a phenol resin, an isocyanate group-containing resin, etc., or a curing agent such as an amine, etc.

The abrasion resistance of the film which forms the surface layer is largely affected by curing temperature. Too high curing temperatures lower the ductility of the resin to cause peeling of the film.

Heat-treatment temperature also affects the cleaning characteristics, so that it is necessary to properly select an optimum temperature depending upon the mixing ratio of the epoxy resin and the resin or curing agent which crosslinks with the epoxy resin, amount of a catalyzer, etc.

Further, since the resin constituting the surface layer of the present invention is an insulator, an increase in the film thickness improves the abrasion resistance, but also increases the residual potential in the photoreceptor. It is therefore desirable that the optimum film thickness is in a range of about 0.1 to about 1.0 μm, although it varies with the kind of resins used.

The film hardness and resistance of the surface layer are determined by the resin in which the inorganic insulator pieces have been buried. It is therefore preferred to use high-resistance and high-hardness resins. For example, those having a surface resistance of $10^{12}$ Ω or more and Mohs' hardness of 2 to 4 are preferably used.

In the present invention, it is also desirable for the inorganic insulator pieces to protrude from the curable resin in order to withstand prolonged abrasion in the inside of electrophotographic apparatus.

It is preferred to select an optimum protrusion amount on the basis of a distance between the inorganic insulator pieces at the film surface, said distance being determined by the particle size of a toner used in electrophotographic apparatus loaded with the photoreceptor, the particle size, fiber length or fiber diameter of the inorganic insulator pieces to be dispersed, and the dispersion amount of the insulator pieces. In order to obtain sufficient abrasion resistance, cleaning characteristics, etc., it is desirable to select the protrusion amount so that portions in which at least the inorganic insulator pieces are not present, i.e. hollows at the surface of the surface layer comprising the curable resin film and inorganic insulator pieces are not brought into direct contact with the toner. In other words, it is desirable to control the size and dispersion amount of the inorganic insulator pieces so as to satisfy the following formula:

$$\text{Protrusion amount} > \frac{1}{2}\left\{\left(\text{particle size of toner}\right) - \sqrt{\left(\text{particle size of toner}\right)^2 - \left(\text{distance between inorganic insulator pieces}\right)^2}\right\}$$

The distance between inorganic insulator pieces referred to herein means a distance between the points of contact of the insulator pieces with the toner particle. The protrusion amount means a distance between the point of contact and the surface of the hollow on resin film.

By causing the inorganic insulator pieces to protrude from the surface layer in this manner, the toner and inorganic insulator pieces can be brought into point-contact with each other at several points.

The more the dispersion amount, the less protrusion amount will suffice. When the dispersion amount is too large, however, aggregation of the inorganic insulator pieces or falling of the pieces from the resin film owing to insufficient burying of the pieces in the resin film are easy to occur. Consequently, there is an optimum range for the dispersion amount, and the dispersion amount is 5 to 60 vol. %, preferably 5 to 40 vol. % based on the volume of the resin film.

It is advantageous to us the inorganic insulator pieces larger in size than the thickness of the resin film, because the protrusion amount can easily be controlled. However, in order to prevent the inorganic insulator pieces from falling-off during abrasion, the inorganic insulator pieces need to be well embedded in the resin film. That is, it is desirable for respective inorganic insulator pieces to be buried by at least half, preferably two-thirds or more. In order to realize such a form of burying, inorganic insulator pieces of enough size to give a predetermined protrusion amount may be selected when the surface layer is formed. It is also possible, however, to cure the resin film containing dispersed large-sized inorganic insulator pieces, polish the surface of the cured resin and cut the protruding inorganic insulator pieces until an optimum protrusion amount is obtained. For the polishing, buffing, etc. may properly be selected.

The size of the inorganic insulator pieces used in the surface layer of the present invention is specifically 0.1 to 1.5 μm, preferably 0.15 to 1.0 μm. The size of inorganic insulator pieces referred to herein is a particle size when the pieces are in the form of particles, and a fiber diameter or fiber length when in the form of fibers.

It is desirable that the inorganic insulator has a high resistivity of 10 to $10^{19}$ Ωcm, preferably $10^{13}$ to $10^{17}$ Ωcm. At the same time, it is desirable for the insulator to have a high hardness, specifically, Mohs' hardness of 4 to 10, preferably 7 to 10.

In order to disperse the inorganic insulator pieces in the resin film uniformly, it is desirable to cover the surface of the insulator pieces with an organometallic compound, for example, a silane coupling agent. By dispersing the inorganic insulator pieces in the resin film in this way, affinity and adhesiveness of the insulator pieces with the resin film is further improved to obtain a higher mechanical strength.

In dispersing the inorganic insulator pieces, polyvinyl butyral resins, fluorine-containing surface active agents, etc. may be added as a dispersing agent to the resin film.

Further, considering the cleaning characteristics, it is desirable that the protrusion amount is equal to or smaller than the thickness of the resin film, preferably half or less of the thickness. In order to protrude the inorganic insulator pieces, the particle size, fiber length or fiber diameter of the inorganic insulator pieces is preferably 1 to 2 times, more preferably 1.0 to 1.5 times the thickness of the resin film.

The electrophotographic photoreceptor of the present invention is characterized by comprising a photoconductive layer containing a photoconductor, a support for the photoconductive layer and a surface layer formed on the photoconductive layer and comprising a curable resin film and inorganic insulator pieces dispersed in and protruded from the resin film, the protrusion amount (c) of the inorganic insulator pieces satisfying the following formula:

$$c > \tfrac{1}{2}\left(a - \sqrt{a^2 - b^2}\right)$$

where a is the particle size of a toner used in forming images and b is a distance between the inorganic insulator pieces.

The electrophotographic photoreceptor of the present invention is characterized in that the surface layer comprises a curable resin film and inorganic insulator pieces, and the thickness of the resin film is smaller than the particle size, fiber length or fiber diameter of the inorganic insulator pieces.

Also, the electrophotographic photoreceptor of the present invention is characterized in that the surface layer comprises a curable resin film and inorganic insulator pieces, and the particle size, fiber length or fiber diameter of the inorganic insulator pieces is larger than the thickness of the curable resin film.

Further, the electrophotographic photoreceptor of the present invention is characterized in that the surface layer consists mainly of a curable resin film, and inorganic insulator pieces and a fluorine-containing lubricant have been dispersed in the surface layer.

The electrophotographic photoreceptor of the present invention is characterized in that the surface layer comprises a curable resin film and inorganic insulator pieces, and the surface layer is covered with a fluorine-containing lubricant. Preferably, the surface layer is continuously covered therewith. The fluorine-containing lubricant is preferably a water-repellent material having a perfluoropolyoxyalkyl group or perfluoropolyoxyalkylene group.

The fluorine-containing lubricant comes out mainly to the surface of the resin film to form a very thin water-repellent lubricant layer and contributes to improvements in the water repellency, lubricity and abrasion resistance of the surface layer of photoreceptors. Also, the lubricant lowers the friction coefficient of the surface, thereby improving the cleaning characteristics and preventing the toner adhesion problem.

The fluorine-containing lubricant used in the present invention is preferably one having a structure in which a perfluoropolyoxyalkyl or perfluoropolyoxyalkylene group has been bonded by a fluorine-free group, being soluble in a common solvent (e.g. Freon (trifluorotrichloroethane made by du Pont), methyl ethyl ketone) and taking a solid state at room temperature. The lubricant, however, may take a liquid state at room temperature. For example, preferred lubricants are those having a structure, in which a long-chain water-repellent group has been bonded by a hydrophilic group, represented by the formula:

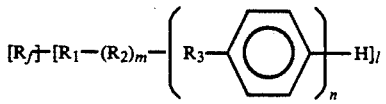

wherein $R_f$ represents a perfluoropolyoxyalkyl or perfluoropolyoxyalkylene group, $R_1$ represents a direct bond, —$CH_2O$—, —COO— or —CONH—, $R_2$ represents a $C_2$— or $C_3$-oxyalkylene group, $R_3$ represents a direct bond, —O—, —COO—, —CONH—, —HNCO—, —$OC_pH_2P$— (in which p is 1 or 2) or —$C(CH_3)_2$— which may be different for each repeating unit, m is an integer of 0 or more, n is an integer of 1 or more, and l is 1 or 2.

When the lubricant has the above structure, it is mechanically embedded and fixed in the surface of the resin film.

Consequently, the fluorine-containing lubricant is embedded in the resin in a state wherein the perfluoropolyoxyalkyl or perfluoropolyoxyalkylene group comes out to the resin surface to cover the surface and the fluorine-free group is entirely embedded in the resin.

Next, examples of the fluorine-containing lubricant fixed in the resin by the chemical bonding of its fluorine-free group with the resin, will be shown.

(1) A fluorine-containing lubricant having an isocyanate group represented by the formula:

$$[R_f]-[R-(R')_p-(NCO)_q]_r$$

wherein $R_f$ represents a perfluoropolyoxyalkyl or perfluoropolyoxyalkylene group, R, which is a bonding group, represents —CONH—, —OCONH— or —$CH_2$OCONH—, R' represents a divalent or trivalent saturated aliphatic hydrocarbon group preferably having 5 to 20 carbon atoms, or a divalent or trivalent aromatic hydrocarbon group preferably represented by the formulae,

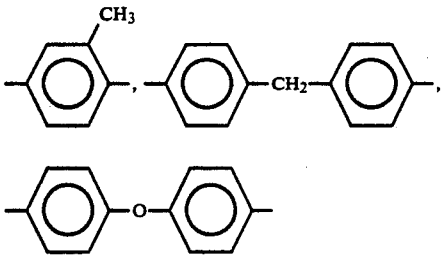

p is an integer of 0 or more, preferably 1, and q and r are independently 1 or 2.

(2) A fluorine-containing lubricant having an isocyanate group represented by the formula:

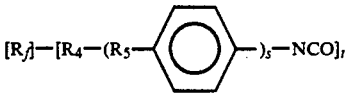

wherein $R_f$ represents a perfluoropolyoxyalkyl or perfluoropolyoxyalkylene group, $R_4$ represents a direct bond, —$CH_2$—, —CO— or amido bond, $R_5$ represents a direct bond, ether bond, ester bond, amido bond or —$OC_kH_{2k}$— which may be different for each repeating unit, s is an integer of preferably 1 to 3, and t and k are independently an integer of 1 or 2.

(3) A fluorine-containing lubricant having a silanol group at the terminal of the fluorine-free group represented, for example, by the following formula;

$$[R_f]-[R_6-R_7-Si(R_8)_u]_v$$

wherein $R_f$ represents a perfluoropolyoxyalkyl or perfluoropolyoxyalkylene group, $R_6$ represents —CONH—, —COO— or —$CH_2$—, $R_7$ represents a $C_2$–$C_4$ alkylene group, $R_8$ represents a $C_1$–$C_3$ oxyalkylene group, u is an integer of 1 to 3 and v is 1 or 2.

(4) A fluorine-containing lubricant having a polyamic acid structure at the terminal of the fluorine-free group.

As the perfluoropolyoxyalkyl or perfluoropolyoxyalkylene group by $R_f$ those represented by the following formulae are preferred:

$$F(C_3F_6-O)_X C_2F_4-,$$

$$F(C_3F_6-O)_X(CF_2O)_Y CF_2-$$

-continued $$-[(C_2F_4O)_Y(CF_2O)_Z CF_2]-$$

wherein X, Y and Z are independently an integer of 1 or more, and particularly X is 5 or more, preferably 10 or more, Y is 10 to 25 and Z is 10 to 56.

When the lubricant having the above structure is contained in the resin film, the perfluoropolyoxyalkyl or perfluoropolyoxyalkylene group is poor in affinity to the resin, so that it comes out to the resin surface to form a lubricant layer.

The thickness of the lubricant layer depends upon the formula weight of the perfluoropolyoxyalkyl or perfluoropolyoxyalkylene group, being about 4 to about 6 nm for the structure of $$F-(C_3F_6-O)_{14}-C_2F_4-.$$

On the other hand, since the hydrophilic group has a good affinity to the resin, it stays in the inside of the resin film to take a mechanically embedded state. As a result, the lubricant is fixed to the surface of the resin film to exhibit effects to improve the water repellency and lubricity and lower the friction coefficient. Particularly, the water repellency is a characteristic not attained until the lubricant is fixed to the surface of the resin film, and also has an effect to prevent moisture from permeation to the resin.

Such the lubricant characteristics of the fluorine-containing lubricant depend largely upon the fluorine chain length of the perfluoropolyoxyalkyl or perfluoropolyoxyalkylene group. The longer the fluorine chain becomes, the more the lubricant characteristics improve and the smaller the friction coefficient becomes. In the above formulae, when X, Y or Z is less than 5, the fluorine chain becomes so short that the lubricant effect is almost lost. If a common fluorine-containing surface active agent having a perfluoroalkyl group is used, it comes out to the resin surface and fixed thereto like the lubricants of the present invention. However, when such the perfluoroalkyl group is used in the surface layer, because the number of carbon atoms is a maximum of about 16, it exhibits a water-repellency improving effect, but not an improved lubricity, as a result of which the cleaning characteristics become poor and the toner adhesion problem is caused at the time of prolonged use.

The fluorine-containing lubricant used in the present invention has a long hydrophilic group, so that it can exhibit both the effect of a surface active agent and the effect of a dispersing agent for the inorganic insulator pieces. The surface layer of the present invention is formed by coating, and the coating can be carried out stably and with good reproducibility because the sedimentation of the inorganic insulator pieces in the coating solution can be prevented by the addition of the lubricant of the present invention.

More specific examples of the lubricant will be shown below:

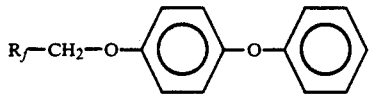

(1)

-continued

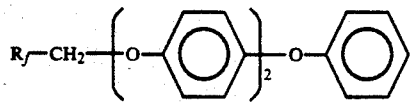

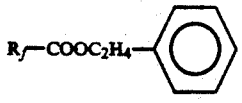

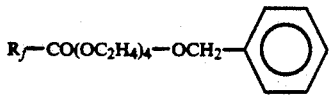

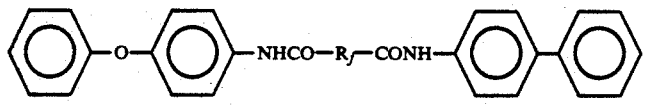

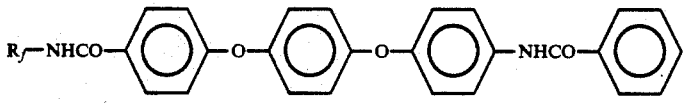

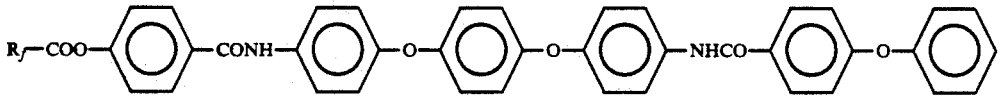

(2) lubricants having an isocyanate group at the terminal of the fluorine-free group such as

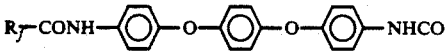

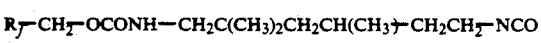

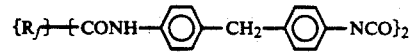

(3) those having a silanol group at the terminal of the fluorine-free group,

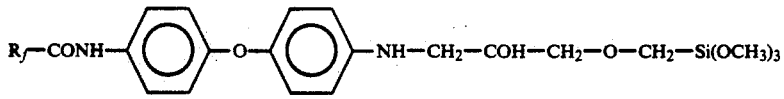

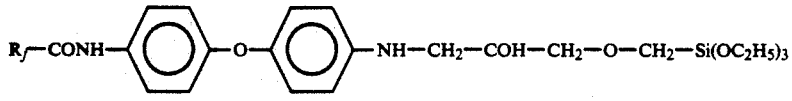

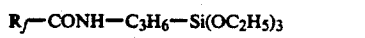

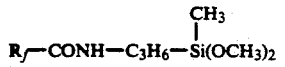

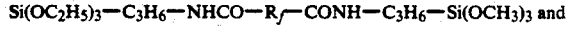

(4) those having a polyamic acid structure at the terminal of the fluorine-free group,

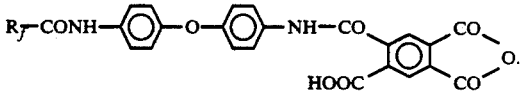

In the above formulae, $R_f$ represents a perfluoropolyoxyalkyl or perfluoropolyoxyalkylene group.

Those lubricants may be mixed with a coating solution for the resin film formation and used for simultaneous formation of the resin film and lubricant layer. Alternatively, the lubricant layer may be formed by firstly forming the resin film, and then applying the coating solution for the lubricant layer formation. How to form the lubricant layer may properly be selected.

Further, when the fluorine-containing lubricant is used in the surface layer of the electrophotographic photoreceptor, it prevents the resin from absorbing moisture, so that the range of selection of the resin can be extended.

The surface layer of the electrophotographic photoreceptor of the present invention comprises the curable resin and inorganic insulator pieces and also has a high resistance, specifically, resistance of $10^{12}$ to $10^{19}$ Ω, preferably 10—to $10^{17}$ Ω. At the same time, the surface layer has a high hardness, specifically, Mohs' hardness of 3 to 6, preferably 4 to 5.

The electrophotographic photoreceptor of the present invention may have any form of drum, belt and sheet. The drum form, however, is preferred.

The electrophotographic photoreceptor of the present invention is characterized by comprising a photoconductive layer comprising a photoconductor, a support for the photoconductive layer and a surface layer formed on the photoconductive layer and comprising a curable resin film in which inorganic insulator pieces and a fluorine-containing lubricant have been dispersed.

The electrophotographic photoreceptor of the present invention is characterized by comprising a photoconductive layer comprising a photoconductor, a support for the photoconductive layer and a curable resin film which is formed on the photoconductive layer and continuously covered with a fluorine-containing lubricant, and in which inorganic insulator pieces have been dispersed.

The electrophotographic photoreceptor of the present invention is characterized by comprising a photoconductive layer comprising a photoconductor, a support for the photoconductive layer and a surface layer formed on the photoconductive layer and comprising a fluorine-containing curable resin film and inorganic insulator pieces.

A fluorine-containing curable resin is a resin having a molecular structure containing fluorine or a fluorine-containing group such as perfluoroalkyl, and can be cured by heating, light, etc. By selecting a proper fluorine content of the resin, low water absorption and high water repellency can be achieved without lowering the hardness or mechanical strength of the resin film. Moreover, this resin is prevented from oxidation or other denaturation during corona discharge.

When the surface layer of the curable resin film is covered with the fluorine-containing lubricant as mentioned above, the fluorine-containing lubricant may be abraded by prolonged repetition of printing process and may disappear. Therefore, a fluorine-containing curable resin keeps water repellency and durability for corona irradiation to the same extent as in the initial stage even if the surface layer is slightly abraded. For example, when both of the surface layer composed of no fluorine-containing resin covered with a fluorine-containing lubricant and the surface layer composed of a fluorine-containing resin are rubbed with a fur brush and a toner, it becomes clear from the analysis of the rubbed surface layers by XPS (X-ray Photoelectron Spectrometry) that after a rubbing treatment equivalent to printing of 3 million pages, the fluorine content of the former surface layer reduces by half, compared with the initial content, whereas that of the latter keeps constant.

Accordingly, the surface layer composed of a fluorine-containing curable resin more contributes to long life of the surface layer as compared to the surface layer composed of no fluorine-containing curable resin. It is preferred to combine the fluorine-containing curable resin and the fluorine-containing lubricant. In such a case, the surface layer can achieve the long life.

The electrophotographic photoreceptor of the present invention is characterized by comprising a photoconductive layer comprising a photoconductor, a support for the photoconductive layer and a replaceable surface layer formed on the photoconductive layer.

The dispersion amount of the inorganic insulator pieces dispersed in the surface layer of the electrophotographic photoreceptor of the present invention will be specifically shown below.

(1) When alumina ($Al_2O_3$) particles of 0.4 μm in average particle size are dispersed as the inorganic insulator pieces in the resin film of 0.3 μm in average thickness, the number of the insulator pieces based on the volume of the resin after curing is as follows:
(i) 7 per 5 $\mu m^2$ for 3 vol. % of the insulator pieces
(ii) 13 per 5 $\mu m^2$ for 6 vol. % of the insulator pieces
(iii) 65 per 5 $\mu m^2$ for 40 vol. % of the insulator pieces
(iv) 90 per 5 $\mu m^2$ for 60 vol. % of the insulator pieces In this case, the upper limit is 90 per 5 $\mu m^2$ for 60 vol. %, preferably 65 or less per 5 $\mu m^2$ for 40 vol. %.

(2) When alumina ($Al_2O_3$) particles of 0.7 μm in average particle size are dispersed in the resin film of 0.5 μm in average thickness, the number of the insulator pieces based on the volume of the resin after curing is as follows:
(i) 4 per 5 $\mu m^2$ for 6 vol. % of the insulator pieces
(ii) 7 per 5 $\mu m^2$ for 10 vol. % of the insulator pieces
(iii) 21 per 5 $\mu m^2$ for 40 vol. % of the insulator pieces
(iv) 28 per 5 $\mu m^2$ for 60 vol. % of the insulator pieces (3) When alumina ($Al_2O_3$) particles of 1.5 μm in average particle size are dispersed in the resin film of 1.0 μm in average thickness, the number of the insulator pieces based on the volume of the resin after curing is as follows:
(i) 3 per 5 $\mu m^2$ for 25 vol. % of the insulator pieces
(ii) 4 per 5 $\mu m^2$ for 40 vol. % of the insulator pieces
(iii) 6 per 5 $\mu m^2$ for 60 vol. % of the insulator pieces
(iv) 3 per 10 $\mu m^2$ for 6 vol. % of the insulator pieces
(v) 5 per 10 $\mu m^2$ for 6 vol. % of the insulator pieces
(vi) 16 per 10 $\mu m^2$ for 6 vol. % of the insulator pieces
(vii) 24 per 10 $\mu m^2$ for 60 vol. % of the insulator pieces Insulator pieces having an average size smaller than the average film thickness can also be used, but in this case, some of the insulator pieces do not protrude from the film surface, and are completely embedded in the film, so that more insulator pieces need to be dispersed in order to cause them to protrude from the film surface.

In selecting the size and dispersion amount of the inorganic insulator pieces, it is necessary to take into account the average particle size of a toner which is a developer and a carrier, used in the electrophotographic apparatus and the thickness of fibers of cleaning brushers.

For example, in the printer in which a two-components development is used and a fur brush is used as the cleaning brush, when a toner of about 10 μm in average particle size, a carrier of about 100 μm in average particle size and a brush of about 20 μm in fiber diameter are used, it is desirable to select the size and dispersion amount of the insulator pieces on the basis of the particle size of the toner.

Specifically, in order to cause the insulator pieces to protrude so that the toner is not brought into direct contact with the dent portion of the surface layer, i.e. the portion where the insulator pieces are not present but the resin alone is present, the following is necessary.

(1) when the average thickness of the resin film is 0.3 μm and the particle size of the insulator pieces is 0.4 μm, the average distance between the insulator pieces shall be 2 μm or less, and the dispersion amount of the insulator pieces shall be 13 pieces or more per 5 $\mu m^2$ and 6 vol. % or more based on the resin, (2) when the average thickness of the resin film is 0.3 μm and the average size of the insulator pieces is 0.5 μm, the average distance between the insulator pieces shall be 2.8 μm or less, and the dispersion amount of the insulator piece shall be 7 pieces or more per 5 $\mu m^2$ and 4 vol. % or more based on the resin, and (3) when the average thickness of the resin film is 0.5 μm and the average size of the insulator pieces is 0.7 μm, the average distance between the insulator pieces shall be 2.8 μm or less, and the dispersion amount of the insulator pieces shall be 7 pieces or more per 5 $\mu m^2$ and 10 vol. % or more based on the resin.

Further, in printers in which a toner of small particle size, for example, 5 μm in average particle size is used in order to obtain high-precision printing, the average distance between the insulator pieces needs to be smaller.

For example, (1) when the average thickness of the resin film is 0.3 μm and the average size of the insulator pieces is 0.5 μm, the average distance between the insulator pieces shall be 1.96 μm or less, and the dispersion amount of the insulator pieces shall be 12 vol. % or more based on the resin, and (2) when the average thickness of the resin film is 0.5 μm and the average size of the insulator pieces is 0.7 μm, the average distance between the insulator pieces shall be 1.96 μm or less, and the dispersion amount of the insulator pieces shall be 22 vol. % or more based on the resin.

The electrophotographic photoreceptor of the present invention is characterized comprising a photoconductive layer comprising a photoconductor, a support for the photoconductive layer and a surface layer formed on the photoconductive layer comprising a curable resin film of 0.1 to 1 μm in thickness and inorganic insulator pieces of 0.1 to 1.5 μm in average size, the insulator pieces being dispersed in the resin film in an amount of 3 pieces or more on an average per 5 $\mu m^2$ of the resin film and protruding from the resin film.

When the inorganic insulator has a fibrous form, the proper range of the fiber diameter is the same as described above on the size of the particle-form insulator. Once again, herein, the fiber diameter in the fibrous form and the particle diameter in the particle form insulator are collectively referred to as the size.

Also, it is desirable that the length of the fibrous inorganic insulator is longer than 1.5 μm in terms of fixation in the resin mass and 100 μm or less in terms of the image quality obtained.

The electrophotographic apparatus of the present invention is loaded with an electrophotographic photoreceptor comprising a photoconductive layer, a surface layer formed on the photoconductive layer and a support for the photoconductive layer, the surface layer comprising a curable resin and inorganic insulator pieces and the insulator pieces protruding from the resin. Further, the electrophotographic apparatus of the present invention has a means to give static charge to the photoreceptor, a means to give a required electromagnetic signal to the photoreceptor, thereby selectively erasing the static charge to form a static latent image, a means to give a developer to the formed static latent image to develop the latent image, a means to supply a recording medium and a means to fix the developed image on the recording medium.

Further, the electrophotographic apparatus of the present invention is characterized in that when the apparatus is loaded with a drum-form photoreceptor having a diameter of 120 mm or more, preferably 200 mm or more, the surface temperature of the photoreceptor is 40° C. or less. Warm-up time is preferably 15 minutes or less. The warm-up time referred to herein means a time required for the apparatus to start actually after switched on. The warm-up time of the electrophotographic apparatus is in practice a time required for regulation of the optical system, heating of the heat roller, heat-drying of the photoreceptor, etc. Since, however, the electrophotographic apparatus of the present invention do not substantially require a time for the heat-drying of the photoreceptor, the warm-up time can largely be shortened.

Usually, in the apparatus loaded with a photoreceptor in which amorphous silicon is used as the photoconductor, the photoreceptor surface is heat-dried with a heater set at the central portion of the photoreceptor. The electrophotographic apparatus of the present invention, however, can be assembled without setting a heater at the central portion of the photoreceptor. The central portion can be utilized, therefore, for purposes other than heating or drying means.

Further, the electrophotographic apparatus of the present invention has an electrophotographic photoreceptor to be heated by substantially frictional heat alone and a means to drive the photoreceptor at a peripheral speed of 6 m/min or more, preferably 18 m/min or more. "Substantially frictional heat alone" referred to above means there being no heating means other than spontaneous rise in temperature.

A method for producing the electrophotographic photoreceptor of the present invention is characterized by comprising the steps of (1) applying a coating solution containing a curable resin and inorganic insulator pieces to the photoreceptor having a photoconductive layer, and (2) drying the coating solution to form a surface layer.

In this connection, a method for producing the surface layer in which the inorganic insulator pieces have been dispersed will be described with reference to amorphous silicon photoreceptors.

For producing the amorphous silicon photoreceptors, the plasma CVD method, sputtering method, reactive evaporation method, photo CVD method, magnetron CVD method, ECR plasma CVD method, etc. may properly be selected. The amorphous silicon photoreceptor does not have to be one obtained immediately after production, but may be one after use in an electrophotographic apparatus.

First, a suitable known three-dimensional curable resin and the foregoing fluorine-containing lubricant and a coupling agent are dissolved in a suitable solvent, for example methyl ethyl ketone. To the resulting solution is added inorganic insulator pieces, for example α-alumina particles, and the mixture is kneaded or mixed with a kneader or ball mill. Thereafter, the film of this solution is formed on the surface of the photoreceptor. For forming the film, a dipping method, rotational coating method, spraying method, etc. may properly be selected.

Thereafter, the formed film is heat-treated at 80° to 180° C. for about 0.5 to about 2 hours to vaporize the solvent. At this stage, the fluorine chain-containing group of the fluorine-containing lubricant comes out to the surface of the resin film, and the fluorine-free group of the lubricant remains in the resin film. The film is then heat-treated at 180° to 350° C. for 1 to 3 hours to complete the formation of the surface layer. The fluorine-containing lubricant is buried in and fixed to the surface of the resin film as it keeps the above state. Particularly, the lubricant having an isocyanate group, silanol group or polyamic acid structure at the terminal is chemically fixed to the surface of the resin film.

When the fluorine-containing lubricant having a silanol group at the terminal is used, it may be fixed to the film surface by applying a mixture of the resin and insulator pieces, heat-treating to crosslink the resin applying a mixed solution of the fluorine-containing lubricant and a suitable solvent, for example a fluorine-containing solvent and then heat-treating at 100° to 200° C. for 2 hours or less.

The surface layer of the present invention can be removed and re-formed when deteriorated. For removing the layer, there is a method wherein high-temperature baking is effected for 1 to 2 hours at a temperature higher by 20° to 50° C. than the curing temperature used when the surface layer is formed, and then the surface layer is strongly rubbed with cloth containing water, an alcohol, an organic solvent, etc. Other methods are buffing, etc. These methods may be properly selected.

Further, in order to cause the inorganic insulator pieces to protrude, it is necessary to properly control the thickness of the curable resin film. For this purpose, it is desirable to properly select the resin concentration of the coating solution, coating conditions and heat-treatment time and temperature at the time of drying the coating solution.

The coating solution for producing the surface layer of the electrophotographic photoreceptor of the present invention contains 100 parts by weight of the curable resin, 300 to 5000 parts by weight of a solvent and 10 to 200 parts by weight of the inorganic insulator pieces, the solvent being one capable of dissolving the curable resin By regulating the amounts of the curable resin and solvent, the film thickness of surface layer of the photoreceptor can be changed.

A method for producing the electrophotographic photoreceptor of the present invention is characterized by comprising the steps of applying a coating solution containing 100 parts by weight of a curable resin, 300 to 5000 parts by weight of a solvent and 10 to 200 parts by weight inorganic insulator pieces of 0.1 to 1.5 μm in size to a photoconductive layer comprising a photoconductor, the solvent being one capable of dissolving the curable resin; and drying the coating solution so that the insulator pieces protrude from the curable resin film, thereby forming a surface layer.

A method for producing the electrophotographic photoreceptor of the present invention is characterized by comprising the steps of applying a coating solution containing a curable resin and inorganic insulator pieces to a photoconductive layer comprising a photoconductor; drying said coating solution so that said insulator pieces protrude from said resin film, thereby forming a surface layer; applying a coating solution containing a fluorine-containing lubricant to said surface layer; and drying said coating solution to cover the surface of said surface layer with said fluorine-containing lubricant.

In order to cause the inorganic insulator pieces to protrude from the resin film, it is desirable to properly select the concentration of the coating solution, coating method, drying method, etc.

The electrophotographic process of the present invention is characterized by comprising the steps of driving a photoreceptor using amorphous silicon as a photoconductor and having a surface layer substantially at room temperature; giving static charge to the surface layer; giving a required electromagnetic signal to said photoreceptor, thereby erasing said static charge selectively to form a static latent image; giving a developer to said formed static latent image to develop said latent image; and fixing the developed image to a medium.

Further, the electrophotographic process of the present invention is characterized in that a drum- or belt-form photoreceptor using amorphous silicon as a photoconductor is heated with substantially frictional heat alone, and at the same time driven at a peripheral speed of 6 m/min or more, preferably 18 m/min or more and charging, exposure, development, fixing and required treatments are carried out.

Further, the electrophotographic process of the present invention is characterized by comprising the steps of giving static charge to an electrophotographic photoreceptor comprising a surface layer comprising a curable resin film and inorganic insulator pieces protruding from said curable resin film; giving a required electromagnetic signal to said photoreceptor, thereby erasing said static charge selectively to form a static latent image; and giving a developer to said photoreceptor having said static latent image formed thereon so that said developer comes into substantial contact with said insulator pieces, thereby developing said latent image.

Further, the electrophotographic process of the present invention is characterized by comprising the steps of giving static charge to an electrophotographic photoreceptor comprising a surface layer comprising a curable resin film and inorganic insulator pieces protruding from said curable resin film giving a required electromagnetic signal to said photoreceptor, thereby erasing said static charge selectively to form a static latent image; and giving a developer to said photoreceptor having said static latent image formed thereon so that said developer does not come into substantial contact with the portion of said surface layer where no inorganic insulator pieces are present, thereby developing said latent image.

In the present invention, operations such as static charging, static latent image formation, development, fixing, etc. for taking an electrophotograph can be carried out by making use of the conventional known techniques.

A method for using an electrophotographic photoreceptor of the present invention is characterized by comprising the steps of driving the electrophotographic photoreceptor having a surface layer and carrying out charging, exposure, development, fixing and required treatments and then using said photoreceptor; removing the surface layer from the photoreceptor and re-forming the surface layer; driving the electrophotographic photoreceptor having the reformed surface layer and carrying out charging, exposure, development, fixing and required treatments and then using said photoreceptor.

The conventional electrophotographic photoreceptors with amorphous silicon are remarkably oxidized at the surface layer in the process of charging due to corona irradiation carried out in the inside of the electrophotographic apparatus. Because of this, use of the apparatus in high-humidity conditions facilitates adsorption of water to the surface layer to lower the surface resistance. As a result, charge transfer on the surface causes image blurring.

The surface layer of the electrophotographic photoreceptor of the present invention is composed of a high-resistance and chemically stable resin and a high-hardness inorganic insulator, so that the surface layer which are of high resistance, undergo no chemical changes and have excellent mechanical strength can be realized.

By using such a high-resistance surface layer, high-reliability electrophotographic photoreceptors which generate no image blurring can be obtained.

Also, by loading electrophotographic apparatus with this photoreceptor, the electrophotographic apparatus which is constituted without a heat-drying means such as a heater, etc. can be produced.

In the present invention, in other words, various characteristics required for the surface layer of electrophotographic photoreceptors, i.e. humidity resistance, durability for corona irradiation, abrasion resistance, cleaning characteristics, the prevention of toner adhesion problem, etc. are compatible with one another and can be satisfied in good balance. Consequently, the same clear images as initial ones can be ensured over the long period of time.

The conventional amorphous silicon photoreceptor has problems that it is oxidized at the surface by corona irradiation and lowers in surface resistance by prolonged use to deteriorate in humidity resistance. In order to prevent this deterioration in humidity resistance, therefore, the conventional photoreceptor contains a heater and is heated to about 40° to about 50° C. when used. By the present invention, however, it becomes possible to realize a photoreceptor which does not require such a heater and can be driven even at a surface layer temperature of 40° C. or less. Also, there is no need to heat the photoreceptor, so that its other portions are not adversely affected. Further, the photoreceptor contains no heater, so that it is light in weight, becoming suitable for use in electrophotographic apparatus for which high-speed rotation is more and more required in future. The cost of the electrophotographic apparatus can be reduced, so that consumed electric power also can be reduced. Since there is no need to heat the photoreceptor, the toner adhesion problem can be prevented even with a low-melting toner. Further, the range of selection of the toner becomes so wide that a fixing device for fixing the toner to recording media such as paper, etc. need not have a high ability.

Further, the electrophotographic photoreceptor of the present invention has a surface layer which is a resin film containing the inorganic insulator pieces protruding from its surface and the fluorine-containing lubricant.

The presence of the inorganic insulator pieces largely improves the abrasion resistance of the film. The fluorine-containing lubricant comes out to the surface to form a lubricant layer which contributes to improvement in water repellency, prevention of the resin from absorbing moisture and reduction in friction coefficient, and largely improves the moisture resistance, durability for corona irradiation and cleaning characteristics.

The life of the photoreceptor of the present invention can be lengthened by the removal and reformation of the surface layer, so that it becomes possible to largely reduce the cost per sheet of the photoreceptor.

The electrophotographic photoreceptor of the present invention can satisfy various characteristics such as humidity resistance, durability for corona irradiation, abrasion resistance, cleaning characteristics, etc. in good balance. Further, it is a long-lived and high-reliability electrophotographic photoreceptor with which problems such as image blurring, toner adhesion problem, etc. have been solved.

Further, the surface layer of the photoreceptor of the present invention can be removed and then re-formed, so that the photoreceptor can also be used in cycle.

Further, the electrophotographic apparatus of the present invention have an effect that there is no need to heat-dry the photoreceptor.

The resin film of the present invention has a structure in which the inorganic insulator pieces protrude from the film surface, so that when a spherical toner is used, it is supported on many points (many tips of the protruding insulator pieces) on the surface. This structure, therefore, does not affect the movement of the toner in the direction normal to the photoreceptor surface, but can inhibit said movement in the direction parallel with the photoreceptor surface. Consequently, high-quality images can also be obtained when photoreceptors having the surface layer of the present invention are used in high-precision printers of 240 dots or more per inch and color printers in which toners of two or more colors such as black, red, etc. are successively applied to the photoreceptor. Particularly, high-quality images can be obtained on high-speed and high-precision color printers containing a photoreceptor rotating at a peripheral speed of 10 m or more per minute.

Various steps such as charging, exposure, development, transferring, cleaning, etc. are carried out on the photoreceptor contained in the electrophotographic apparatus, so that in order to withstand prolonged repeated use, the surface layer, an outermost surface, of the photoreceptor is required to have high mechanical strength and chemical stability.

That is, the surface layer is required to have the following properties:

(1) No reduction in film thickness by abrasion at the time of the development, transferring and cleaning,
(2) No change in adhesiveness between the surface layer and the ground film,
(3) No oxidation of the layer by corona irradiation and evolution of nitrogen oxides ($NO_X$) at the time of charging, and
(4) No embrittlement nor quality change of the film by exposure to light.

Also, no change in the friction coefficient of the film surface is necessary in order to maintain good cleaning characteristics. The surface layer of the present invention satisfies all the requirements described above, so that it can realize a long-lived electrophotographic photoreceptor.

EXAMPLE 1

One embodiment of the present invention will be illustrated with reference to FIG. 1.

FIG. 1 is a schematic view illustrating the film structure of the amorphous silicon photoreceptor of the present invention.

In FIG. 1, 101 is an Al tube, 102 is a blocking layer, 103 is a photosensitive layer and 104 is a protective layer.

On the Al tube of 120 mmϕ×300 mm (length) 101 were successively formed the following layers in a plasma CVD reactor using a radio frequency of 13.56 MHz:

(1) an a-SiC:H:B blocking layer 102 produced with a mixed gas of monosilane, ethylene, diborane and hydrogen, (2) an a-Si:H:B photosensitive layer 103 produced with a mixed gas of monosilane, diborane and hydrogen, and (3) an a-SiC:H surface protective layer 104 produced with a mixed gas of monosilane, ethylene and hydrogen.

The thickness of the layers were 2 μm for the blocking layer 102, 30 μm for the photosensitive layer 103 and 0.5 μm for the protective layer 104.

This photoreceptor was taken out of the plasma CVD reactor, and a surface layer 107 of the present invention was applied to it.

The coating solution was prepared by dissolving a resin 105 comprising (1) 91.5 g of a tetrafunctional epoxy resin precursor (trade name, XD9053; produced by Du Pont Co.), (2) 148.5 g of a p-vinylphenol polymer (trade name, Maruka Lyncur M; produced by Cosmo Oil Co., Ltd.), (3) 0.92 g of triethylammonium calibrate (trade name, TEA-K; produced by Hokko Chemical Industry Co., Ltd.), and (4) 36 g of polyvinyl butyral (trade name, BX-1; produced by Sekisui Chemical Co., Ltd.), in 1260 g of methyl ethyl ketone and then adding 240 g of α-alumina particles 106 having an average particle size of 0.40 μm (trade name, AKP-30; produced by Sumitomo Chemical Co., Ltd.).

The coating solution was mixed with a ball mill for 10 hours.

This coating solution was applied and heat-treated at 100° C. for 1 hour to evaporate methyl ethyl keton, and at 200° C. for 2 hours to cure the coating film. Thus, a surface layer 107 was formed.

Figure 8:
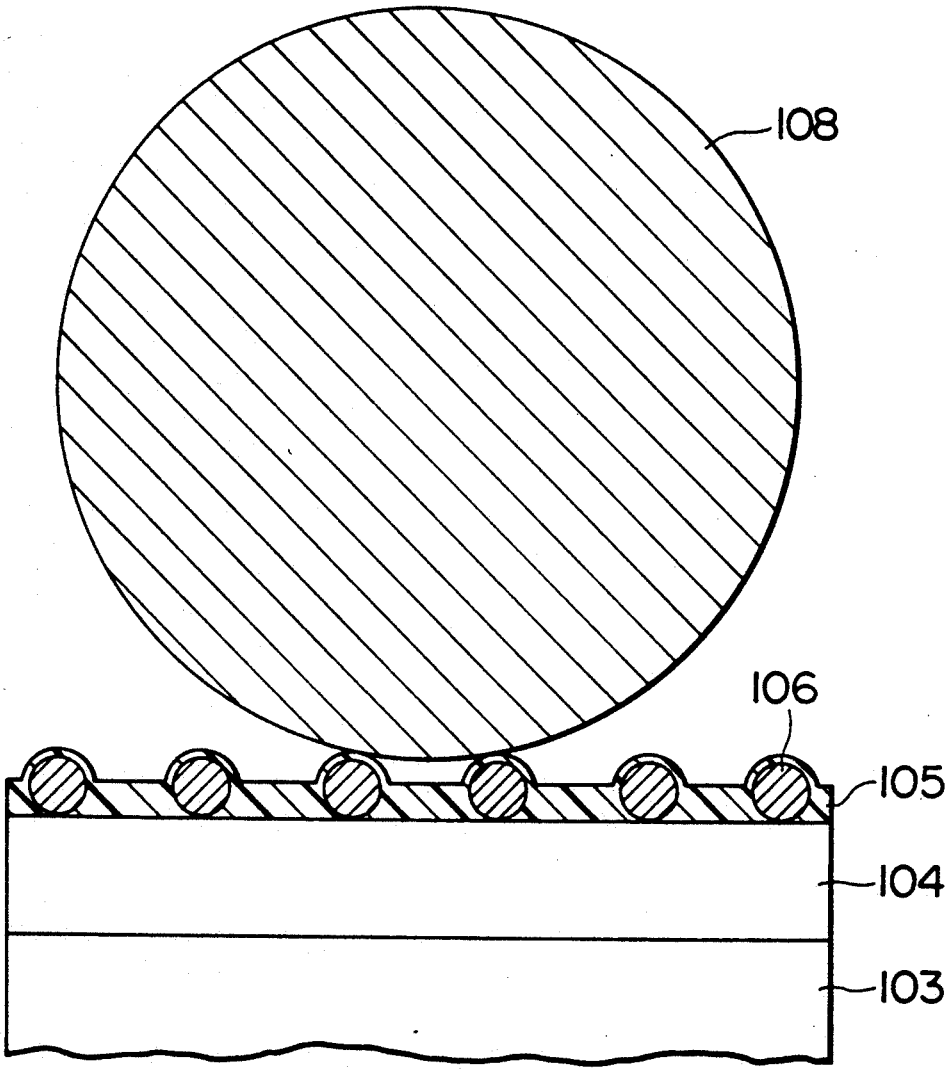
FIG. 8 is a model view representing a condition of contact between a toner and a film surface.

The profile of the film surface was examined by means of a roughness tester to find that the film thickness of the resin portion was about 0.25 μm on an average, and the protrusion amount of the particle was about 0.15 μm on an average. The surface was observe by means of a scanning electron microscope (SEM) to find that the distance between the particles was about 0.5 μm on an average. FIG. 8 is a view illustrating a state in which a toner 108 of 5 μm in particle size is in contact with the surface layer. The toner 108 is not brought into direct contact with the hollow portion of the resin 105, and even if the resin covering the particle 106 is lost by abrasion by contact with the toner, abrasion of the surface layer itself can be prevented.

Figure 2:
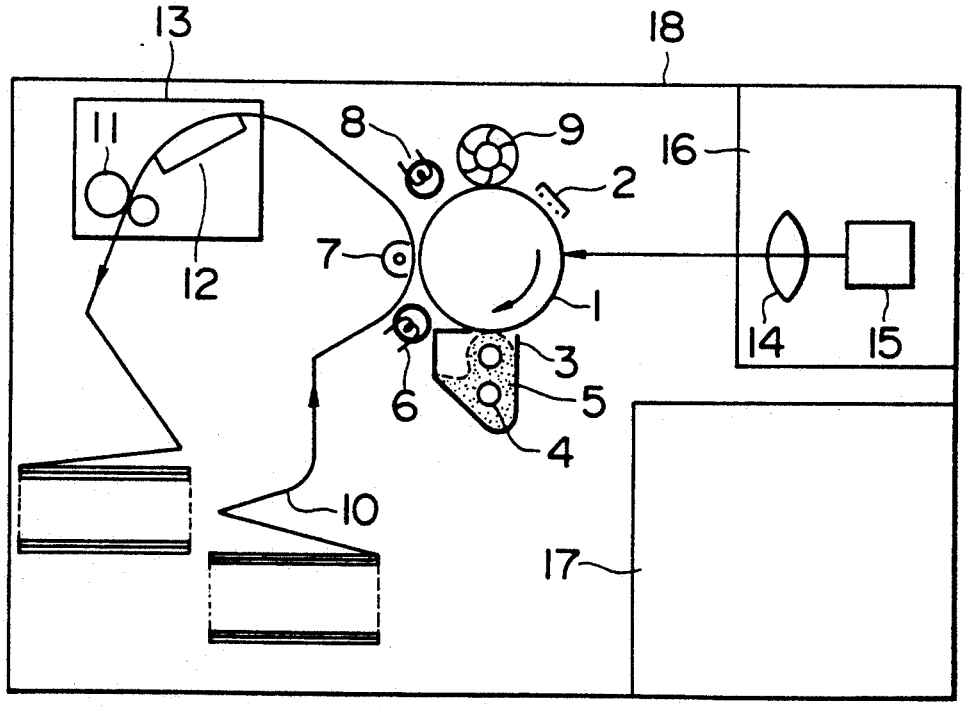
FIGS. 2 and 7 are each a schematic view illustrating the constitution of electrophotographic apparatus to which the present invention is applied.

This photoreceptor was loaded on a laser beam printer 18 (electrophotographic apparatus) shown in FIG. 2, and the printing test was carried out. As a result, the same clear images as the initial ones were obtained until one million pages were printed.

In FIG. 2, 1 is a photosensitive drum, 2 is a charger to give static charge, 3 is a developing device, 4 is a magnetic roller, 5 is a toner and carrier, 6 is a fade lump, 7 is a charger for transferring, 8 is an erase lump, 9 is a cleaner, 10 is paper which is a recording medium, 11 is a heat roller, 12 is a preheater, 13 is a fixing device, 14 and 15 are a lens and a light source for exposure, respectively, constituting an optical system 16, the latter projecting electromagnetic signals for example light, 17 is required controlling system and power source, and 18 is an electrophotographic apparatus. When an LED array is used as a light source, the lens 14 can be removed.

The process of electrophotography carried out in the electrophotographic apparatus is as follows:

(1) Static latent image formed on the surface of the drum-form photoreceptor 1 is developed by bringing it into contact with the toner and carrier 5 which is a developer stirred by the magnetic roller 4.

(2) Electric potential at the portion to which the developer has not adhered is erased by irradiating the drum with the fade lump 6.

(3) Transferring is carried out while bringing paper 10, a recording medium, into contact with the drum and giving charges by means of a charger for transferring 7.

(4) After the transferring, the static latent image on the drum is erased by irradiating the drum with the erase lump 8, and the drum is cleaned with the cleaner 9 provided with a fur brush to prepare for the next step.

(5) The toner image transferred to the paper 10 is fixed by means of the fixing device 13 equipped with the preheater 12 and heat roller 11.

The electrophotographic apparatus 18 of the present invention does not have a means to heat-dry the photoreceptor, for example, a heater, etc.

By using no heater, 1.0 to 1.5 kW of electric power can be saved for a 15 to 20 kW laser beam printer.

Figure 7:
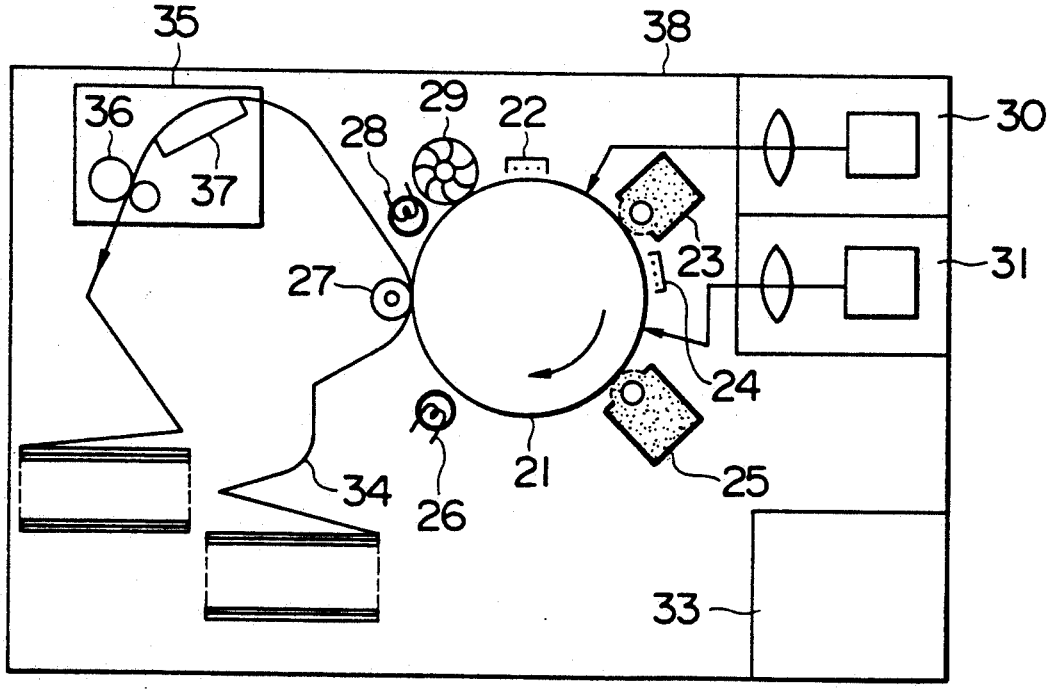

This photoreceptor was loaded on a black/red bicolor laser beam printer 38 shown in FIG. 7 and used for the printing test at varying peripheral speeds of the drum. The result was compared with that obtained with a photoreceptor having no surface layer (Comparative Example 1). As a result, when the photoreceptor of Example 1 was used, problems of color mixing, etc. did not occur even at a peripheral speed of 50 m or more per minute and high-quality images were obtained. Contrary to this, when the photoreceptor of Comparative Example 1 was used, a portion in which the black and red toners are present in mixture began to appear at a peripheral speed of 10 m/min, and at a further high peripheral speed, there occurred a problem of the image becoming obscure by color mixing.

In FIG. 7, 21 is a photosensitive drum, 22 and 24 are a charger giving static charge, 23 is a developing device for adhering the black toner to the photoreceptor, 25 is a developing device for adhering the red toner to the photoreceptor, 30 and 31 are optical systems giving electromagnetic signals, for example, light to form black and red latent images, respectively, 26 is a fade lump, 27 is a charger for transferring, 28 is an erase lump, 29 is a cleaner, 34 is paper, 35 is a fixing device composed of a heat roller 36 and a preheater 37, and 33 is a controlling system. The process of electrophotography carried out in the electrophotographic apparatus is fundamentally the same as in the printer of FIG. 2. In the printer of FIG. 7, however, a process of charging, exposure and development is repeated twice, so that it becomes important that the first colored toner adhered to the photoreceptor does not slip off the place during the second same process.

EXAMPLE 2

Another embodiment of the present invention will be illustrated with reference to FIG. 3.

Figure 3:
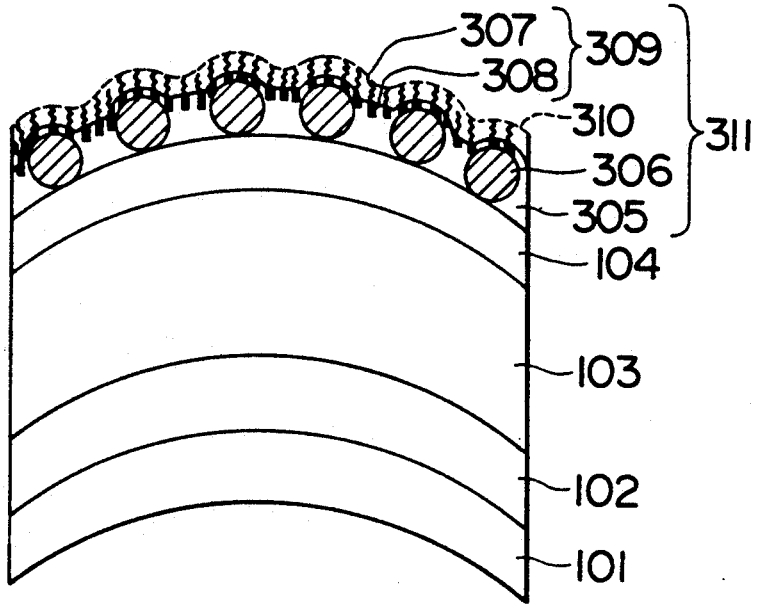
FIGS. 3, 4, 6 and 9 are each a sectional view of an amorphous silicon photoreceptor which is one embodiment of the present invention.

FIG. 3 is a schematic view illustrating the film structure of the amorphous silicon photoreceptor of the present invention.

In FIG. 3, 102 to 104 show the same layers as in FIG. 1.

The manufacturing method and film thickness of these layers are the same as in Example 1 shown in FIG. 1.

Next, an organic surface layer 311 of the present invention was formed.

The coating solution was prepared by dissolving (1) 91.5 g of a tetrafunctional epoxy resin precursor (trade name, XD9053; produced by Du Pont Co.), (2) 148.5 g of a p-vinylphenol polymer (trade name, Maruka Lyncur M; produced by Cosmo Oil Co., Ltd.), (3) 0.92 g of triethylammonium caliborate (trade name, TEA-K; produced by Hokko Chemical Industry Co., Ltd.), and (4) 240 g of an α-alumina particles (trade name, AKP-30; average particle size, 0.4 μm; produced by Sumitomo Chemical Co., Ltd.), in 1260 g of methyl ethyl ketone, mixing the solution and adding 36 g of a fluorine-containing lubricant represented by the following structural formula:

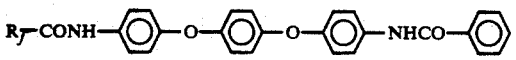

wherein $R_f$ represents $F[CF(CF_3)—CF_2O]_nCF(CF_3)—$ and n is 14 on an average.

To the alumina filler before the mixing was applied a coupling treatment with 5 g of a silane coupling agent (trade name, Sila-Ace S510; produced by Chisso Co.). Mixing of the coating solution was carried out by kneading on a kneader for 4 hours and kneading on a ball mill for 10 hours.

The above amorphous silicon photoreceptor was immersed in this coating solution to form a film and then subjected to pre-stage heat-treatment at 100° C. for 1 hour and post-stage heat-treatment at 200° C. for 2 hours (heat-curing of binder) to complete a surface layer 311.

By the pre-stage heat-treatment after film formation, the perfluoropolyoxyalkyl group 307 of the lubricant 309 comes out, in an oriented state, to the surface of the resin layer 305, and the fluorine-free group 308 is buried and fixed in the resin layer 305. As a result, a water-repellent lubricant layer 310 composed of the perfluoropolyoxyalkyl group is formed on the surface of the surface layer 311. The film thickness of the resin layer 305 was 0.3 μm. A symbol 306 is the alumina filler which is an inorganic insulator.

The photoreceptor thus obtained was loaded on a tester for evaluating photoreceptor characteristics. A corona irradiation test was carried out to the photoreceptor as kept still, and the humidity resistance and durability for corona irradiation were evaluated from the contact angle of water.

The photoreceptor kept still was subjected to a continuous abrasion test using a fur brush with toner to measure the contact angle of water.

The film surface after the abrasion was observed with an optical microscope and electron microscope to examine the presence and absence of scratches and attachments on the surface layer. The results are shown in Table 1.

TABLE 1

| | Contact angle of water before and after corona irradiation or abrasion test (degree) | | | Surface state of surface layer after abrasion for 15 hours | |
|---|---|---|---|---|---|
| | Before test | Corona irradiation time (15 hr) | Abrasion time (15 hr) | Scratches on the surface layer | Attachments |
| Example 2 | 110 | 95 | 90 | None | Absent |
| Comparative Example 1 | 70 | 25 | 70 | None | Absent |

The tests were carried out using a photoreceptor having no surface layer 311 as Comparative Example 1 to obtain the following results.

The following was found as shown in Table 1. The photoreceptor of Example 2 has a high water repellency and no attachments on the surface layer even after the corona irradiation test and abrasion test, which shows that the photoreceptor is also good in the cleaning characteristics. Contrary to this, the photoreceptor of Comparative Example 1 is good in the abrasion resistance and cleaning characteristics, but insufficient in the durability for corona irradiation.

Also, with regard to the surface resistance, the photoreceptor of Comparative Example 1 is inferior to that of Example 2.

Figure 5:
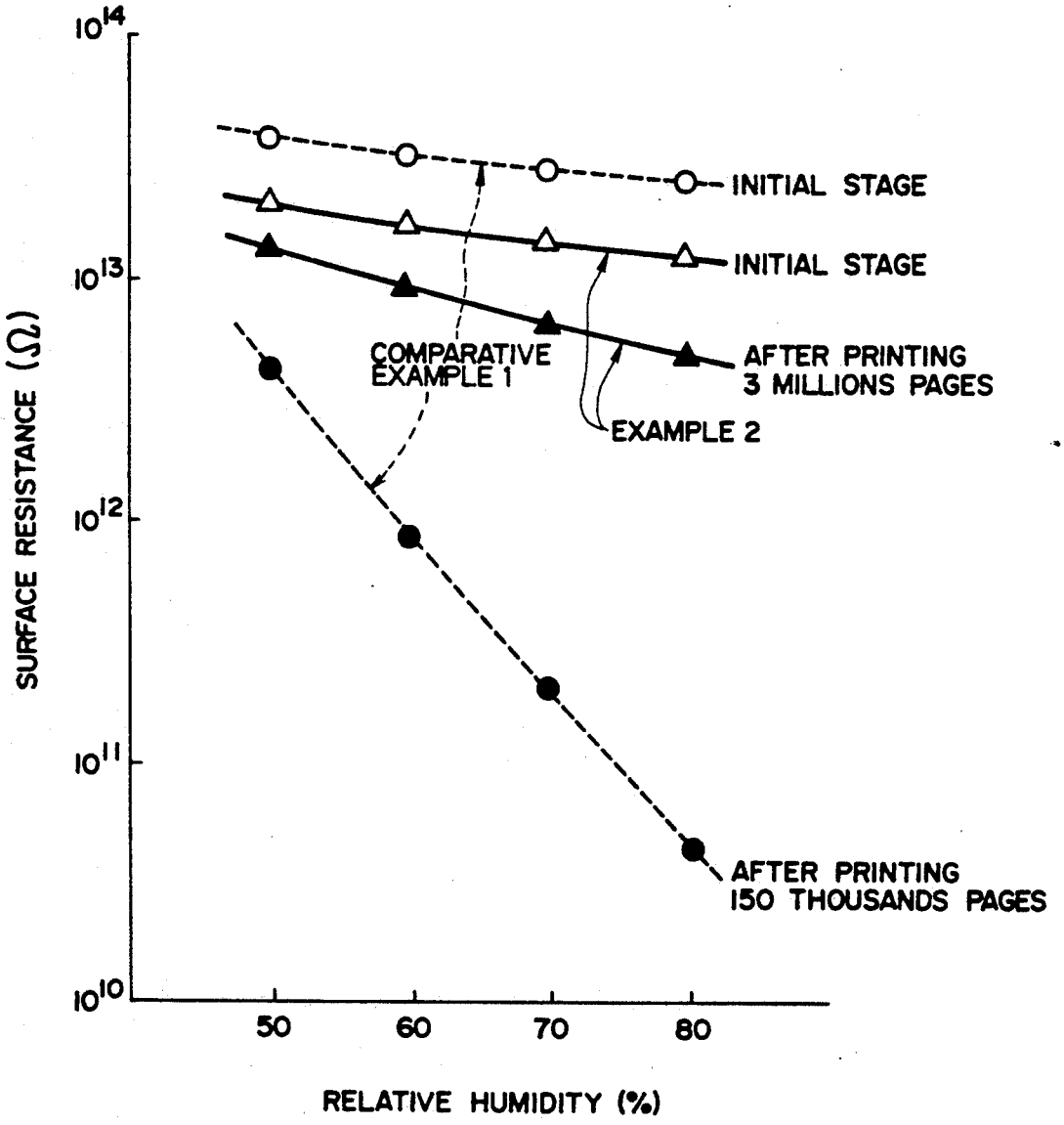
FIG. 5 is a graph of a relationship of relative humidity vs. surface resistance.

FIG. 5 shows the surface resistance before and after the printing test measured on the photoreceptors of Example 2 and Comparative Example 1. The printing test was performed using a laser beam printer 18 shown in FIG. 2.

The surface resistance of the photoreceptor of Example 2 after printing of 3 million pages is low as compared with that before the printing test, i.e. at the initial stage of printing. However, it is small in the degree of lowering, providing to have a resistance as high as $5\times10^{12}$ Ω or more even under 80% RH.

Contrary to this, the surface resistance of the photoreceptor of Comparative Example 1 is higher in the initial value than that of Example 2, but largely lowers after printing of 150 thousand pages, proving to lower to $10^{12}$ Ω or less under 60% RH or higher.

Generation of image blurring is closely related to the value of the surface resistance, and when the surface resistance lowers to about $10^{12}$ Ω or less, the image blurring becomes to appear. It became clear that the photoreceptor of Example 2 is stable to corona irradiation and abrasion applied in the printing process without showing chemical change, and shows excellent humidity resistance even after printing of 3 million pages.

Table 2 shows relationships of the number of printed pages vs. generation of image blurring and toner adhesion problem.

TABLE 2

| | Number of printed pages until generation of image blurring (unit: 10 thousand pages) | Number of printed pages until generation of toner adhesion problem (unit: 10 thousand pages) |
|---|---|---|
| Example 2 | >300 | >300 |
| Comparative Example 1 | 10-30 | >300 |

The image blurring was examined as follows. After printing of a required number of pages, the printer was stopped, and whether the image blurring had appeared or not immediately after the printer was re-driven at 30° C.×80% RH, was examined.

The photoreceptor of Example 2 generated no image blurring nor toner adhesion problem until 3 million pages were printed, and the same clear images as the initial ones were obtained. On the other hand, the photoreceptor of Comparative Example 1 generated the image blurring when about 100 thousand pages were printed.

EXAMPLE 3

The photoreceptor of Comparative Example 1 was loaded on a printer 18 as shown in FIG. 2, and after printing of 500 thousand pages, taken out of the printer 18. Thereafter, the same surface layer as in Example 2 was formed thereon. The image blurring appeared before formation of the surface layer, but did not appear after the formation. The photoreceptor provided with the surface layer was re-loaded on the printer 18 and tested for printing, but the image blurring did not appear until 3 million pages were printed.

EXAMPLE 4

The photoreceptor of Example 2 was loaded on a printer 18 as shown in FIG. 2, and after printing of 3 million pages, taken out of the printer 18. Thereafter, the photoreceptor was subjected to high-temperature heat-treatment at 230° C. for 2 hours and then to buffing for 5 minutes while supplying water, thereby removing the surface layer 311. Thereafter, the surface layer 311 was formed again in the same manner as in Example 2. This photoreceptor was again loaded on the printer 18 and tested for printing. After re-opening the printing test, the image blurring did not appear until 3 million pages were printed.

EXAMPLE 5

The fluorine-containing lubricant used in the coating solution of Example 2 was replaced by five different ones shown in Table 3, and then the surface layer was similarly formed.

The same effect as in Example 2 was obtained with any one of them.

TABLE 3

| Lubricant No. | Structure of lubricant |
|---|---|
| 1 | 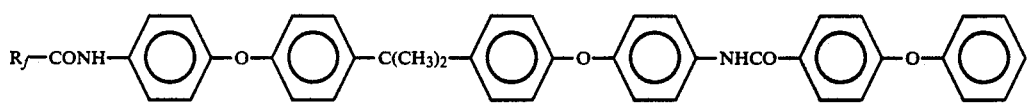 |
| 2 | 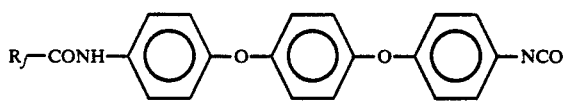 |
| 3 | 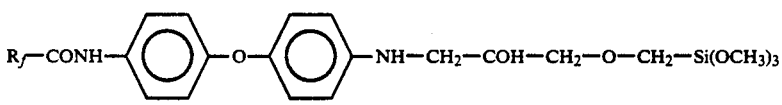 |
| 4 | 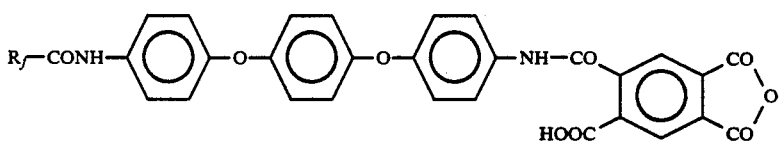 |
| 5 | 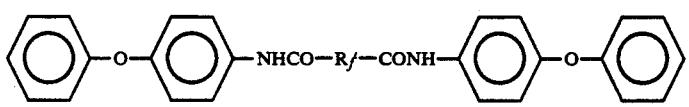 |

In the above formulae, $R_f$ is $F[CF(CF_3)—CF_2O]_n—CF(CF_3)—$ and n is 14 on an average, and $R_f$ is $—(C_2F_4O)_v—(CF_2O)_w—CF_2—$, v is 10 and w is 15 on an average.

EXAMPLE 6

Figure 4:
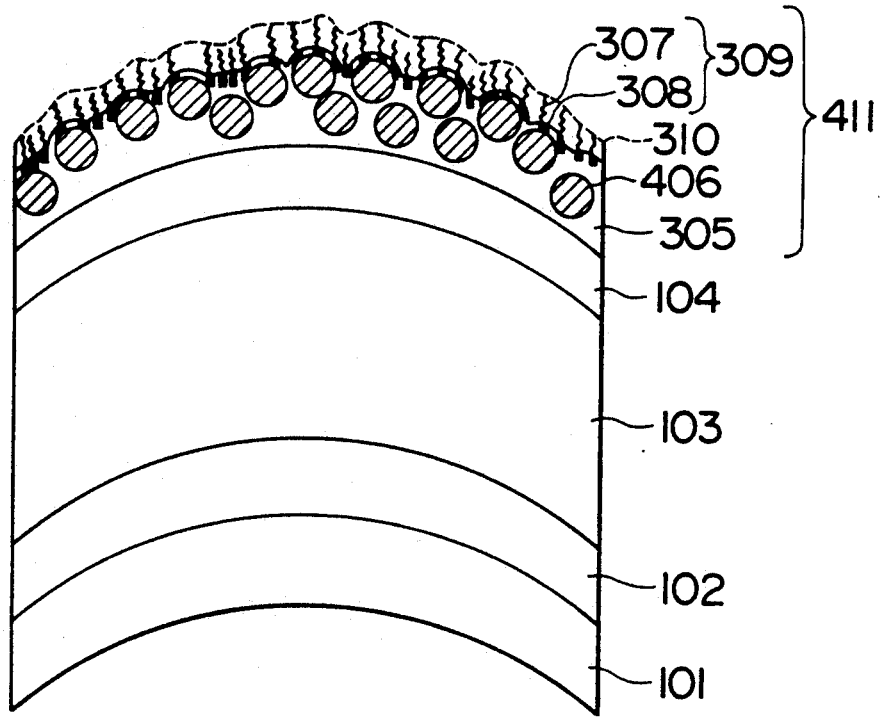

The surface layer 411 shown in FIG. 4 was formed using an amorphous silicon photoreceptor produced by the plasma CVD method. The procedure was the same as in Example 2 except that an α-alumina particles 406 having an average particle size of 0.2 μm (trade name, AKP-50; produced by Sumitomo Chemical Co.) was used in place of the alumina filler used in the coating solution.

In FIG. 4, 101 to 104, 305 and 307 to 310 are the same as those shown in FIG. 3.

The same corona irradiation test and abrasion test as in Example 2 were carried out. The results are shown in Table 4.

TABLE 4

| | Contact angle of water before and after corona irradiation test and abrasion test (degree) | | | Surface state of surface layer after abrasion for 15 hours | |
|---|---|---|---|---|---|
| | Before test | Corona irradiation time (15 hr) | Abrasion time (10 hr) | Scratches on the surface layer | Attachments |
| Example 6 | 110 | 95 | 90 | None | Absent |

As can be seen from Table 4, the photoreceptor of Example 6 also gave nearly the same results as that of Example 2.

Next, the photoreceptor of Example 6 was loaded on a laser beam printer 18, and the printing test was carried out. As a result, the same clear images as the initial ones were obtained until one million pages were printed.

EXAMPLE 7

The organic film was produced by replacing the filler of Example 1 by M-2T having an average particle size of 1.2 μm (produced by Showa Denko Co.). The filler protruding from the resin was polished by buffing so that the protrusion amount was 0.3 μm. This photoreceptor was tested for printing to obtain the same effect as in Example 1.

EXAMPLE 8

Figure 6:
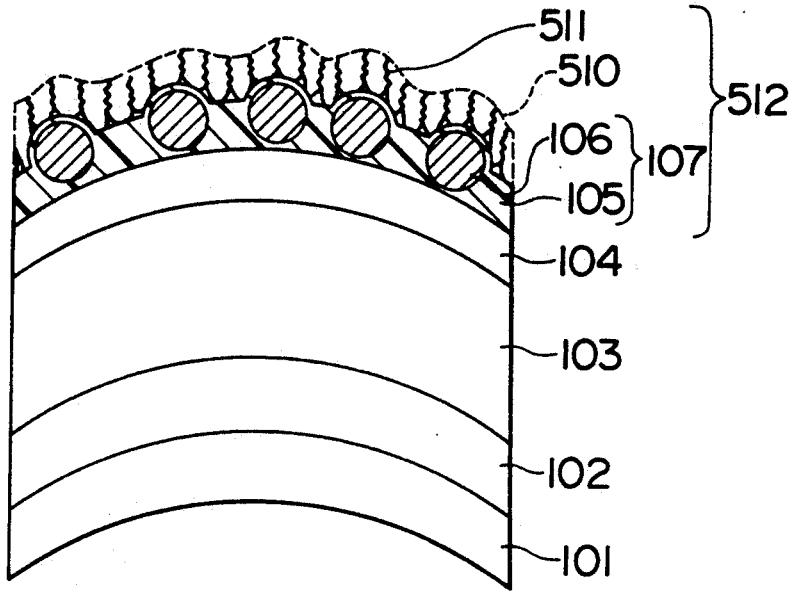

Other embodiment of the present invention will be illustrated with reference to FIG. 6. FIG. 6 is a schematic view illustrating the film structure of the amorphous silicon photoreceptor of the present invention. In FIG. 6, 101 to 107 are the same layers as in FIG. 1, and the manufacturing method and film thickness of these layers are the same as in Example 1.

Next, the lubricant layer 510 was formed as shown below on the surface layer 107. A coating solution was produced by dissolving 5 g of a fluorine-containing lubricant having a silanol group represented by the structural formula:

$$R_f\text{—CONH—}C_3H_6\text{—Si}(OC_2H_5)_3$$

wherein $R_f$ represents $F[CF(CF_3)\text{—}CF_2O]_n\text{—}CF(CF_3)\text{—}$, and n is 29 on an average, at the terminal in 1495 g of trifluorotrichloroethane (S-3). The photoreceptor having the surface layer 107 was immersed in the coating solution to apply the lubricant 511 to the surface of the surface layer 107. Thereafter, the photoreceptor was heat-treated at 150° C. for 30 minutes to allow the terminal silanol group of the lubricant to chemically react with the surface layer 107. Thus, the water-repellent lubricant layer 510 was formed to complete the formation of the surface layer 512. The photoreceptor of FIG. 6 was tested for printing to find that it showed nearly the same results as the photoreceptor of Example 2.

EXAMPLE 9

An amorphous silicon photoreceptor having a three-layer structure of 102 to 104 shown in FIG. 1 was produced in the same manner as in Example 1.

Next, an organic surface layer was formed on this photoreceptor. A fluorine-containing epoxy resin precursor represented by the following structural formula:

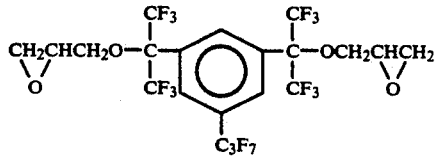

was used as an epoxy resin precursor. A coating solution was produced by dissolving 160 g of the above epoxy resin precursor, 80 g of a p-vinylphenol polymer (trade name, Maruka Lyncur M; produced by Cosmo Oil Co., Ltd ), 1.6 g of triethylammonium caliborate (produced by Hokko Chemical Industry Co., Ltd.) in 1260 g of methyl ethyl ketone and mixing 72 g of an α-alumina particles (trade name, AKP-30; average particle size, 0.4 μm; produced by Sumitomo Chemical Co.) with the resulting solution.

A method for mixing the coating solution was the same as in Example 1. The above amorphous silicon photoreceptor was immersed in this coating solution to form a film, and heat-treated at 100° C. for 1 hour and then at 200° C. for 2 hours to cure the resin. Thus, the formation of the surface layer was completed. The photoreceptor thus obtained was tested for printing, and it was found that the image blurring did not occur even after printing of 6 million pages under conditions of 30° C.×80% RH.

EXAMPLE 10

Using the fluorine-containing epoxy resin, the surface layer was formed on the amorphous silicon photoreceptor in the same manner as in Example 9. In the same manner as in Example 8, the fluorine-containing lubricant having a silanol group at the terminal was applied to this surface layer and heated to fix the coating film to the surface layer. This photoreceptor was tested for printing, and it was found that the image blurring did not occur and clear images were obtained even after printing of 10 million pages under conditions of 30° C.×80% RH.

EXAMPLE 11

Figure 9:
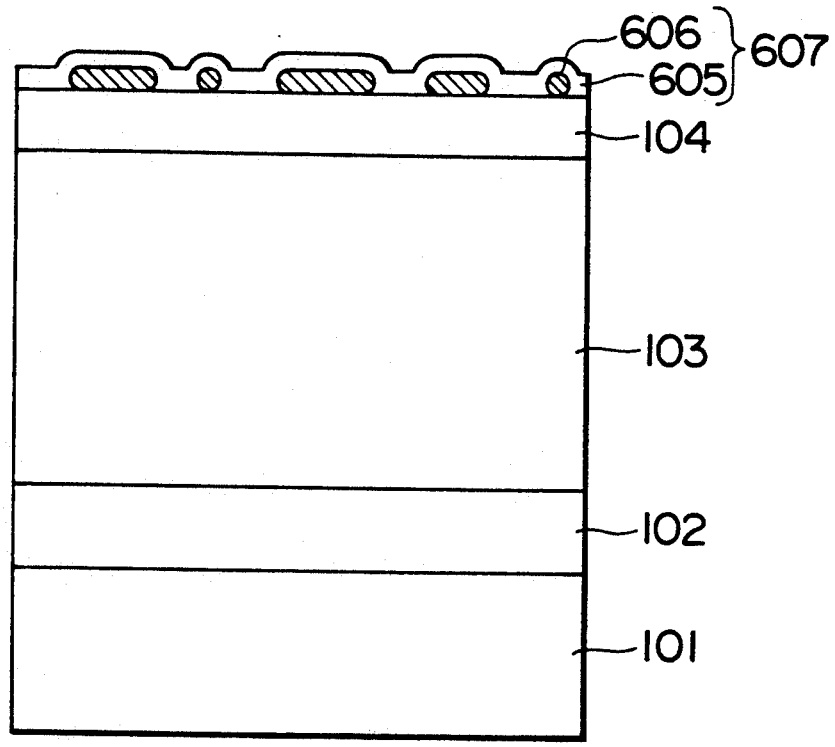

FIG. 9 is a schematic view illustrating the film structure of the amorphous silicon photoreceptor of the present invention. An amorphous silicon photoreceptor was produced in the same manner as in Example 1. In FIG. 9, 101 to 104 are the same layers as in FIG. 1.

Next, this photoreceptor was taken out of the plasma CVD reactor, and the surface layer 607 of the present invention was formed thereon as shown below.

The coating solution was prepared by dissolving a resin 605 comprising (1) 91.5 g of a tetrafunctional epoxy resin precursor (trade name, XD9053; produced by Du Pont Co.), (2) 148.5 g of a p-vinylphenol polymer (trade name, Maruka Lyncur M; produced by Cosmo Oil Co., Ltd.), (3) 0.92 g of triethylammonium caliborate (trade name, TEA-K; produced by Hokko Chemical Industry Co., Ltd.), and (4) 4.8 g of aluminum diisopropoxide monoethylacetoacetate (trade name, EP-12; produced by Hope Seiyaku Co.), in 1260 g of methyl ethyl ketone, and then adding 80 g of silicon nitride whisker 606 of 0.2 to 0.5 μm in diameter and 5 to 10 μm in length (trade name, Silicon Nitride Whisker SNW; produced by Tateho Chemical Industries Co., Ltd.) to the resulting solution.

This coating solution was coated and heat-treated at 200° C. for 2 hours to cure the coating film. Thus, a surface layer 607 was formed. The thickness of the resin film 605 was 0.3 μm.

This photoreceptor was loaded on a laser beam printer (electrophotographic apparatus) 18 shown in FIG. 2 and tested for printing. As a result, the same clear images as the initial ones were obtained until one million pages were printed.

EXAMPLE 12

After forming the layers 102 to 104 in FIG. 1 in the same manner as in Example 1, the photoreceptor was taken out of the plasma gas-phase reactor, and a surface layer 607 was formed thereon.

The coating solution was prepared by dissolving a resin 605 comprising (1) 91.5 g of a tetrafunctional epoxy resin precursor (trade name, XD9053; produced by Du Pont Co.), (2) 148.5 g of a p-vinylphenol polymer (trade name, Maruka Lyncur M; produced by Cosmo Oil Co., Ltd.), (3) 0.92 g of triethylammonium caliborate (trade name, TEA-K; produced by Hokko Chemical Industry Co., Ltd.), and (4) 4.8 g of aluminum diisopropoxide monoethylacetoacetate (trade name, EP-12; produced by Hope Seiyaku Co.), in 1260 g of methyl ethyl ketone, and then adding 80 g of silicon nitride whisker 606 of 0.2 to 0.5 μm in diameter and 5 to 10 μm in length (trade name, Silicon Carbide Whisker SCW; produced by Tateho Chemical Industries Co., Ltd.) to the resulting solution.

This coating solution was applied and heat-treated at 200° C. for 2 hours to cure the coating film. Thus, a surface layer 607 was formed. The thickness of the resin film 605 was 0.3 μm.

This photoreceptor was loaded on a laser beam printer (electrophotographic apparatus) 18 shown in FIG. 2 and tested for printing. As a result, the same clear images as the initial ones were obtained until one million pages were printed.

What is claimed is:

1. An electrophotographic photoreceptor comprising a photoconductive layer including a photoconductor, a support for said photoconductive layer and a surface layer formed on said photoconductive layer, and comprising a curable resin film of 0.1 to 1 μm in thickness and inorganic insulator pieces having a size larger than the film thickness of said curable resin film, said inorganic insulator pieces being dispersed at an average interval of no more than about 2.8 μm in said resin film and protruded to a height of at least 0.1 μm from said resin film so that a toner forming an image is supported by the protruded inorganic insulator pieces on said surface layer.

2. An electrophotographic photoreceptor comprising a photoconductive layer including a photoconductor, a support for said photoconductive layer, and a surface layer formed on said photoconductive layer and comprising in organic insulator pieces and a curable resin film having a film thickness smaller than the size of said inorganic insulator pieces, said inorganic insulator pieces being dispersed at an average interval of no more than about 2.8 μm in said resin film and protruded to a height of at least 0.1 μm from said resin film so that a toner forming an image is supported by the protruded inorganic insulator pieces on said surface layer.

3. An electrophotographic photoreceptor comprising a photoconductive layer including a photoconductor, a support for said photoconductive layer, and a surface layer formed on said photoconductive layer and comprising a curable resin film of 0.1 to 1 μm in thickness and inorganic insulator pieces dispersed at an average interval of no more than about 2.8 μm in said resin film and protruded to a height of at least 0.1 μm from said resin film so that a toner forming an image is supported by the protruded inorganic insulator pieces on said surface layer.

4. An electrophotographic photoreceptor comprising a photoconductive layer including a photoconductor, a support for said photoconductive layer, and a surface layer formed on said photoconductive layer and comprising a curable resin film of 0.1 to 1 μm in thickness in which inorganic insulator pieces and a fluorine-containing lubricant have been dispersed, said inorganic insulator pieces being dispersed at an average interval of no more than about 2.8 μm from each other in said resin film and protruded to a height of at least 0.1 μm from said resin film so that a toner forming an image is supported by the protruded inorganic insulator pieces on said surface layer.

5. An electrophotographic photoreceptor comprising a photoconductive layer including a photoconductor, a support for said photoconductive layer, and a curable resin film of 0.1 to 1 μm in thickness which is formed on said photoconductive layer and continuously covered with a fluorine-containing lubricant, and in which inorganic insulator pieces have been dispersed at an average interval of no more than about 2.8 μm in said resin film and protruded to a height of at least 0.1 μm from said resin film so that a toner forming an image is supported by the protruded inorganic insulator pieces on said surface layer.

6. An electrophotographic photoreceptor comprising a photoconductive layer including a photoconductor, a support for said photoconductive layer, and a surface layer formed on said photoconductive layer and comprising a curable resin film of 0.1 to 1 μm in thickness and inorganic insulator pieces, said surface layer having a surface resistance of $10^{12}$ to $10^{19}$ Ω and Mohs' hardness of 3 to 5 at the surface, said inorganic insulator pieces being dispersed at an average interval of no more than about 2.8 μm in said resin film and protruded to a height of at least 0.1 μm from said resin film so that a toner forming an image is supported by the protruded inorganic insulator pieces on said surface layer.

7. An electrophotographic photoreceptor comprising a photoconductive layer including a photoconductor, a support for said photoconductive layer, and a surface layer formed on said photoconductive layer and comprising a fluorine-containing curable resin film of 0.1 to 1 μm in thickness and inorganic insulator pieces dispersed at an average interval of no more than about 2.8

μm in said resin film and protruded to a height of at least 0.1 μm from said resin film so that a toner forming an image is supported by the protruded inorganic insulator pieces on said surface layer.

8. An electrophotographic photoreceptor comprising a photoconductive layer including a photoconductor, a support for said photoconductive layer, and a surface layer formed on said photoconductive layer and comprising a curable resin film of 0.1 to 1 μm in thickness and inorganic insulator pieces of 0.1 to 1.5 μm in size covered with said curable resin film, said inorganic insulator pieces being dispersed at an average interval of no more than about 2.8 μm in said resin film and protruded to a height of at least 0.1 μm from said resin film so that a toner forming an image is supported by the protruded inorganic insulator pieces on said surface layer.

9. An electrophotographic photoreceptor according to claim 3, wherein said surface layer is a replaceable surface layer.

10. An electrophotographic photoreceptor including a photoconductive layer comprising a photoconductor, a support for said photoconductive layer, and a surface layer formed on said photoconductive layer and comprising a curable resin film of 0.1 to 1 μm in thickness and inorganic insulator pieces dispersed at an average interval of no more than about 2.8 μm in said resin film and protruded to a height of at least 0.1 μm from said resin film so that a toner forming an image is supported by the protruded inorganic insulator pieces on said surface layer, the protrusion amount (c) of said inorganic insulator pieces satisfying the following formula:

$$c > \tfrac{1}{2}\left(a - \sqrt{a^2 - b^2}\right)$$

where a is the particle size of a toner used in forming images and b is a distance between said inorganic insulator pieces.

11. An electrophotographic photoreceptor comprising a photoconductive layer including a photoconductor, a support for said photoconductive layer and a surface layer formed on said photoconductive layer and comprising a curable resin film of 0.1 to 1 μm in thickness and inorganic insulator pieces of 0.1 to 1.5 μm in average size, said insulator pieces being dispersed at an average interval of no more than about 2.8 μm in said resin film in an amount of 3 pieces or more on an average per 5 $\mu m^2$ of said resin film and protruded to a height of at least 0.1 μm from said resin film so that a toner forming an image is supported by the protruded inorganic insulator pieces on said surface layer.

12. A method for producing an electrophotographic photoreceptor which comprises the steps of applying a coating solution containing 100 parts by weight of a curable resin, 300 to 5000 parts by weight of a solvent and 10 to 200 parts by weight of inorganic insulator pieces of 0.1 to 1.5 μm in size, to a photoconductive layer comprising a photoconductor, said solvent being one capable of dissolving said curable resin; and drying said coating solution so that said insulator pieces protrude from said resin, thereby forming a surface layer.

13. A method for producing an electrophotographic photoreceptor which comprises the steps of applying a coating solution containing a curable resin and inorganic insulator pieces to a photoconductive layer comprising a photoconductor; drying said coating solution so that said insulator pieces protrude from said resin, thereby forming a surface layer; applying a coating solution containing a fluorine-containing lubricant to said surface layer; and drying said coating solution to cover the surface of said surface layer with said fluorine-containing lubricant.

14. An electrophotographic apparatus comprising an electrophotographic photoreceptor having a surface layer formed on a photoconductive layer and comprising a curable resin film and inorganic insulator pieces, said inorganic insulator pieces protruding from said curable resin film; a means to give static charge to said photoreceptor; a means to give a required electromagnetic signal to said photoreceptor, thereby selectively erasing said static charge to form a static latent image; a means to give a developer to the formed static latent image to develop said latent image; a means to supply a recording medium; and a means to fix the developed image on said recording medium.

15. An electrophotographic apparatus comprising an electrophotographic photoreceptor in which amorphous silicon is used as a photoconductor and which is heated by substantially frictional heat along; a means to drive said photoreceptor at a peripheral speed of 6 m/min or more, a means to give static charge to said photoreceptor; a means to give a required electromagnetic signal to said photoreceptor, thereby selectively erasing said static charge to form a static latent image; a means to give a developer to the formed static latent image to develop said latent image; a means to supply a recording medium; and a means to fix the developed image on said recording medium.

16. An electrophotographic apparatus according to any one of claims 1-11, wherein said photoconductive layer is amorphous silicon, the electrophotographic apparatus having no means for drying said surface layer.

17. An electrophotographic process comprising the steps of giving static charge to an electrophotographic photoreceptor comprising a surface layer comprising a curable resin film and inorganic insulator pieces protruding from said curable resin film; giving a required electromagnetic signal to said photoreceptor, thereby erasing said static charge selectively to form a static latent image; and giving a developer to said photoreceptor having said static latent image formed thereon so that said developer comes into substantial contact with said insulator pieces, thereby developing said latent image.

18. An electrophotographic process comprising the steps of giving static charge to an electrophotographic photoreceptor comprising a surface layer comprising a curable resin film and inorganic insulator pieces protruding from said curable resin film; giving a required electromagnetic signal to said photoreceptor, thereby erasing said static charge selectively to form a static latent image; and giving a developer to said photoreceptor having said static latent image formed thereon so that said developer does not come into substantial contact with the portion of said surface layer where no inorganic insulator pieces are present, thereby developing said latent image.

19. An electrophotographic process comprising the steps of driving a photoreceptor using amorphous silicon as a photoconductor and having a surface layer substantially at room temperature; giving static charge to said surface layer; giving a required electromagnetic signal to said photoreceptor, thereby erasing said static charge selectively to from a static latent image; giving a developer to said formed static latent image to develop said latent image; and fixing the developed image to a medium.

20. An electrophotographic process comprising the steps of heating a drum- or belt-form photoreceptor using amorphous silicon as a photoconductor with substantially frictional heat alone, and at the same time driving said photoreceptor at a peripheral speed of 6 m/min or more, thereby carrying out charging, exposure, development, fixation and required treatments.

21. A method for using an electrophotographic photoreceptor comprising the steps of driving the electrophotographic photoreceptor having a surface layer and carrying out charging, exposure, development, fixation and required treatments and then using said photoreceptor; removing the surface layer from said photoreceptor and re-forming the surface layer; and driving said electrophotographic photoreceptor having the re-formed surface layer and carrying out charging, exposure, development, fixation and required treatments and then using said photoreceptor.

22. An electrophotographic photoreceptor comprising a photoconductive layer including a photoconductor, a support for said photoconductive layer, and a surface layer formed on said photoconductive layer and comprising a resin film of 0.1 to 1 μm in thickness and inorganic insulator pieces, said resin film having a molecular structure containing fluorine or a fluorine-containing group, said inorganic insulator pieces being dispersed at an average interval of no more than about 2.8 μm in said resin film and protruded to a height of at least 0.1 μm from said resin film so that a toner forming an image is supported by the protruded inorganic insulator pieces on said surface layer.

23. An electrophotographic photoreceptor comprising a photoconductive layer including a photoconductor, a support for said photoconductive layer, and a surface layer formed on said photoconductive layer and comprising a curable resin of 0.1 to 1 μm in thickness and inorganic insulator pieces, said resin having a molecular structure containing fluorine or a fluorine-containing group, said inorganic insulator pieces being dispersed at an average interval of no more than about 2.8 μm in said curable resin and protruded to a height of at least 0.1 μm from said curable resin so that a toner forming an image is supported by the protruded inorganic insulator pieces on said surface layer.

24. An electrophotographic photoreceptor according to any one of claims 1, 2, 4–8, 10 and 11, wherein said surface layer is a replaceable surface layer.

25. An electrophotographic photoreceptor comprising a photoconductive layer including a photoconductor, a support for said photoconductive layer and a replaceable surface layer formed on said photoconductive layer.

* * * * *